US010753175B2

(12) United States Patent
Stone

(10) Patent No.: US 10,753,175 B2
(45) Date of Patent: Aug. 25, 2020

(54) VALVE AND METHOD

(71) Applicant: Matthew Stone, Humble, TX (US)

(72) Inventor: Matthew Stone, Humble, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/052,230

(22) Filed: Aug. 1, 2018

(65) Prior Publication Data

US 2020/0040702 A1 Feb. 6, 2020

(51) Int. Cl.
*E21B 34/06* (2006.01)
*E21B 34/10* (2006.01)
*E21B 43/25* (2006.01)

(52) U.S. Cl.
CPC ..... *E21B 34/063* (2013.01); *E21B 34/10* (2013.01); *E21B 43/25* (2013.01)

(58) Field of Classification Search
CPC ..... E21B 34/063; E21B 34/10; E21B 34/101; E21B 43/25; Y10T 403/3248; Y10T 403/592
See application file for complete search history.

(56) References Cited

U.S. PATENT DOCUMENTS 3,385,370 A * 5/1968 Knox ..... E21B 21/10 166/317
4,391,328 A * 7/1983 Aumann ..... E21B 34/08 166/321
5,411,049 A * 5/1995 Colvard ..... E21B 21/10 137/71
5,492,146 A 2/1996 George et al.
5,778,989 A * 7/1998 Neumaier ..... B25B 23/141 173/178
2013/0153239 A1 6/2013 McIntosh et al.
2014/0008556 A1 1/2014 Ewers et al.
2014/0083519 A1* 3/2014 Fan ..... G05D 16/0669 137/15.18
2017/0037980 A1 2/2017 Arian et al.

FOREIGN PATENT DOCUMENTS

KR 101878885 B1 7/2018

OTHER PUBLICATIONS

Notification of Transmittal of the International Search Report and the Written Opinion of the International Searching Authority, or the Declaration; PCT/US2019/038377; dated Oct. 10, 2019: 10 total pages.

* cited by examiner

*Primary Examiner* — James G Sayre
(74) *Attorney, Agent, or Firm* — Cantor Colburn LLP

(57) ABSTRACT

A spring biased device having a plurality of operational spring rates including a housing; a first spring disposed between a selective support and a functional component; a second spring disposed between the selective support and another support; and a releasable connection between the selective support and the housing. A valve including a housing; a seat disposed within the housing; poppet movable to a position on the seat and a position off the seat, the poppet having a valve stem; a selective support; another support attached to the housing, the selective support and the another support allowing through passage of the valve stem; a first spring disposed between the selective support and the poppet; a second spring disposed between the another support and the selective support; and a connection between the selective support and the housing, the connection being selectively defeatible.

17 Claims, 3 Drawing Sheets

VALVE AND METHOD

BACKGROUND

In the resource recovery industry it is often desirable to inject fluids that have certain needed effects in order to for example improve production from a subsurface well. Systems that inject fluids may employ injection valves that are often check valves and employ a biasing member to keep the valve closed when a pressure in a chemical injection line is less than required to overcome the biasing member. Generally speaking, formation pressure also works to keep the valve closed so that the overcoming pressure would need to overcome formation pressure as well. Since efficiency and avoiding remedial actions taken from surface, which generally involve runs for retrieving and replacing tools is paramount, the industry always is receptive to improvements.

SUMMARY

A spring biased device having a plurality of operational spring rates including a housing; a first spring disposed between a selective support and a functional component; a second spring disposed between the selective support and another support; and a releasable connection between the selective support and the housing.

A valve including a housing; a seat disposed within the housing; poppet movable to a position on the seat and a position off the seat, the poppet having a valve stem; a selective support; another support attached to the housing, the selective support and the another support allowing through passage of the valve stem; a first spring disposed between the selective support and the poppet; a second spring disposed between the another support and the selective support; and a connection between the selective support and the housing, the connection being selectively defeatible.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
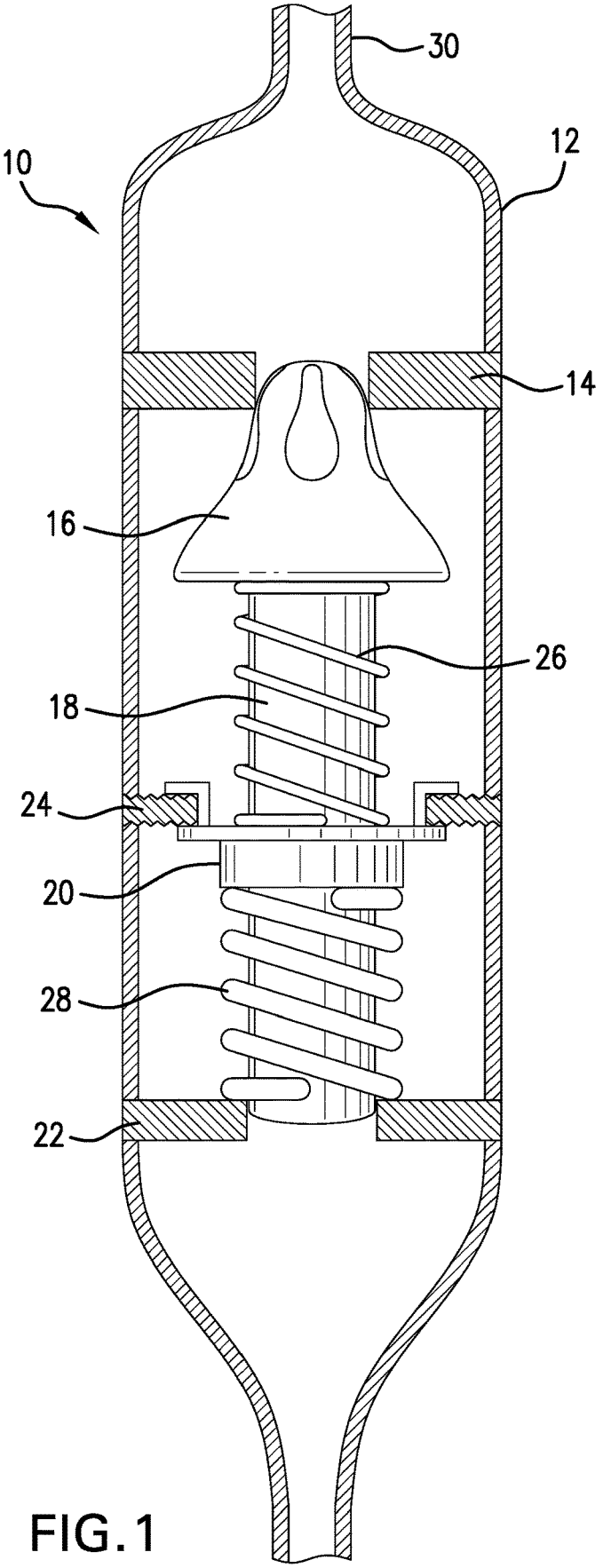
FIG. 1 is a cross sectional view of an embodiment of the biased valve disclosed herein in a first operative condition.

In FIG. 1, a spring biased device 10 is illustrated that improves operational efficiency by ensuring the device stays fully operational as formation pressure depletes over the lifetime of a well (hydrocarbon, CO2 sequestration, etc.). In the illustration the device is configured as a valve although one of skill in the art should recognize that the principals of the device apply more broadly than only a valve.

In the configuration as shown of a valve, the device 10 is described in the paradigm of a chemical injection valve in a wellbore. It is axiomatic that in the initial life of a well, the formation pressure will naturally be higher than it is when the well is nearing the latter portion of its life simply due to the fact that fluid is being withdrawn from the formation. As formation pressure decreases due to drawdown of formation fluids, a back pressure on an injection valve is also reduced. The difference in formation pressure means that cracking pressure to open the valve will change over the life of the well. If a spring too soft is initially used, i.e. there is too much reliance on the formation pressure to keep the valve closed, then toward the end of the life of the well, there is significant risk of the valve leaking due to insufficient force on the valve to stay closed. Hence higher constant springs are used for injection valves to avoid leakage of chemicals through the valve as formation pressure decreases. This makes for very high cracking pressures at the early phases of the life of the well. Further, where leakage does occur, there is a loss of chemicals from the control line 30 feeding the valve at least to the formation. This will be a familiar annoyance to those of skill in the art but of even more concern is the pressure based flashing of chemicals in the injection line 30. Because the line 30 is generally closed at surface, the leaking of chemical fluid to the wellbore when it is unintended leaves a lower pressure environment within a portion of the injection line. At that lower pressure region, the chemicals may vaporize. The vaporized condition of the chemicals may produce a highly caustic or highly acidic environment that can be detrimental to the injection line or even to other well components. All of these issues are solved in the embodiments disclosed herein.

The embodiment of FIG. 1 improves the operational efficiency of a device 10 and as shown a valve 10 by providing for a change in the spring rate of a biasing member of the valve 10 such that a lower spring rate may be employed during the early life of the well and a higher spring rate may be employed during the latter life of the well, during which formation pressure is depleted.

Referring to FIG. 1, the valve 10 includes a housing 12 supporting a valve seat 14. The valve 10 further includes a poppet 16 seatable on the seat 14 to stop flow through the valve 10. The poppet 16 is attached to a valve stem 18. The valve stem 18 passes through a plurality of supports discussed herein as selective support 20 and fixed support 22. It is to be understood that the fixed support 22 in other embodiments might well be another selective support in the event that multiple different spring rates are desired in a device 10. This will become clearer below. It is to be understood that the supports are configured to allow fluid flow therethrough and or there around. The supports 20 and 22 are not intended to be a significant impediment to fluid flow. Fixed support 22, in the illustration of FIG. 1 is permanently fixed within the housing 12 while selective support 20 is temporarily fixed within the housing 12. The temporary fixation of the selective support 20 is through a connection 24 which may be configured as a pin, bolt, disk, or any other connection between the selective support 20 and the housing 12 whereby the selective support 20 is axially immovable relative to the housing 12 until the connection 24 is released. The connection may be chemically degradable, mechanically releasable (such as by shearing), etc. If degradable, the connection 24 may be configured of or comprise a degradable material such as a controlled electrolytic metallic material such as IN-Tallic™ degradable material commercially available from Baker Hughes, a GE company, or other degradable materials such as aluminum, magnesium, and combinations including at least one of the foregoing, etc. As long as the selective support can be converted by action of the connection 24 from an axially fixed member to an axially movable member, the device 10 will function as intended. In the event a degradable material is used, it may be configured to degrade over a period of time from exposure to the injected chemical or it may be configured to degrade in response to a slug of another chemical sent down the control line 30 specifically for the purpose of degrading the connection 24. The former requires preselection of the timing of the release of the selective support and the latter allows for selecting a time for that release more fluidly.

Figure 2:
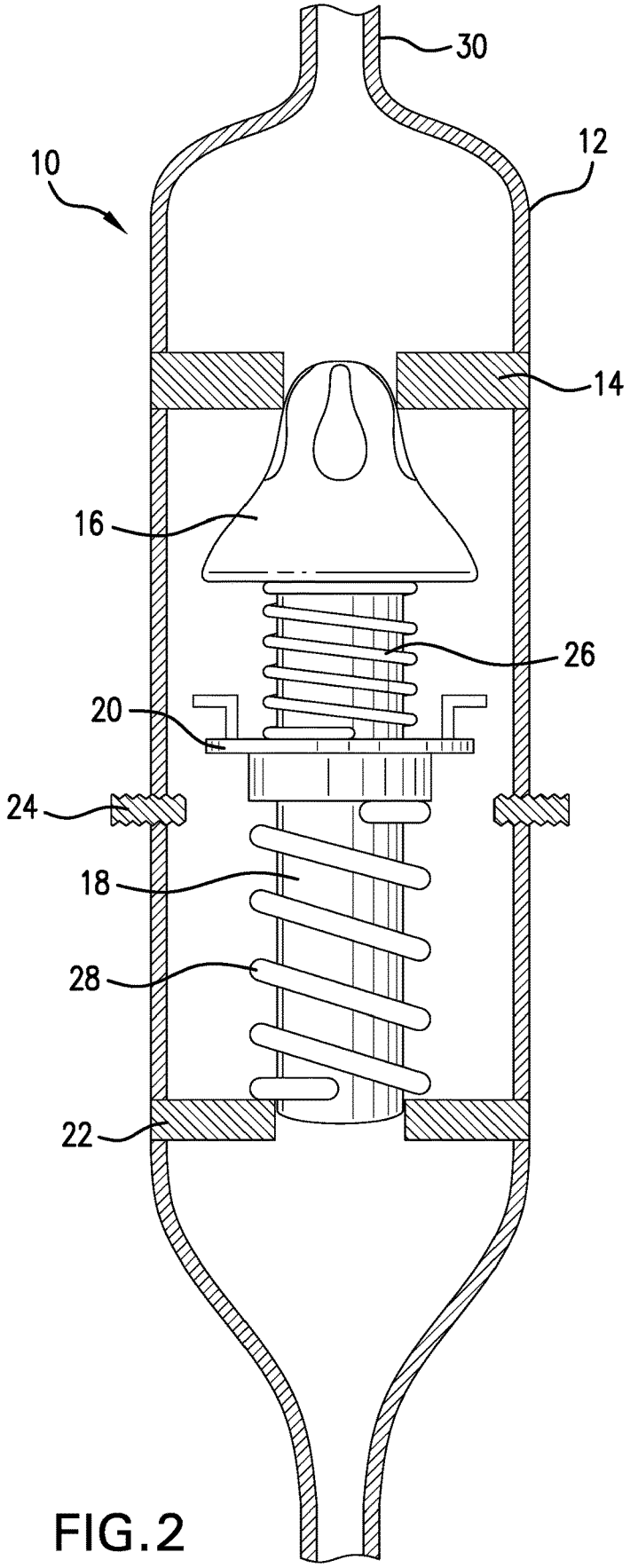
FIG. 2 is the valve in a second operative condition.

Also included in the valve 10 are a plurality of springs termed for convenience first spring 26 and second spring 28. The first spring extends between the poppet 16 and the selective support 20 while the second spring 28 extends between the selective support 20 and the fixed support 22. While the selective support 20 is affixed to the housing 12, the first spring 26 is the bias for the poppet 16 against the seat 14. This is an initial condition in which the valve 10 is workable based upon the action of the first spring 26 and the formation pressure only. Specifically, when an action is taken or command given for injection of chemical, pressure is exerted on the chemical which will urge the poppet 16 off its seat 14. The pressure in the chemical must exceed the first spring 26 and the formation pressure which will naturally exist in a direction tending to force the poppet 16 onto its seat 14. In an early phase of the well, the formation pressure will be relatively higher than at a later phase in the life of the well. During this phase, it is desirable to have a lower spring rate spring 26 urging the poppet closed since the formation pressure itself is already likely to hold the poppet closed. The first spring 26 allows for lower cracking pressures in the chemical injection line due to the lower spring rate first spring 26. As the formation pressure is reduced however, the column of chemical in the control line 30 becomes a greater factor in the unintended opening of the valve 10 and accordingly at a later phase of the well when the formation pressure has been sufficiently depleted, it would be preferable to have a higher spring rate spring such as second spring 28 operationally urging the poppet 16 onto its seat 14. In order to change the valve 10 disclosed herein to a higher rate spring without removing the valve 10 from the well or effecting any other run from the surface, the connection 24 is defeated in one of the ways noted above. Time or pumping a slug of fluid through the chemical injection line 30 that will degrade the connection 24 thereby allowing the selective support 20 to move relative to housing 12 (shown in FIG. 2). The axial freedom of selective support 20 effectively replaces the action of the first spring 26 with that of the second spring 28 by allowing the selective support 20 to float between the two springs 26 and 28. Since spring 28 has a higher rate it will compress the first spring 26 to a column (or nearly so) of whatever material the spring 26 is made of and in effect remove it from the system. The second spring 28 then becomes the spring force of the system of the valve 10 and urges the poppet 16 onto its seat 14 with much greater load than that with which first spring 26 was capable. This is illustrated in FIG. 2. This is a desirable condition since with the formation pressure down, the chemical injection line column requires a stronger spring to keep the poppet closed and if injection is desired, one need only overcome the spring 28 since the formation pressure will have been substantially reduced against the poppet.

Figure 3:
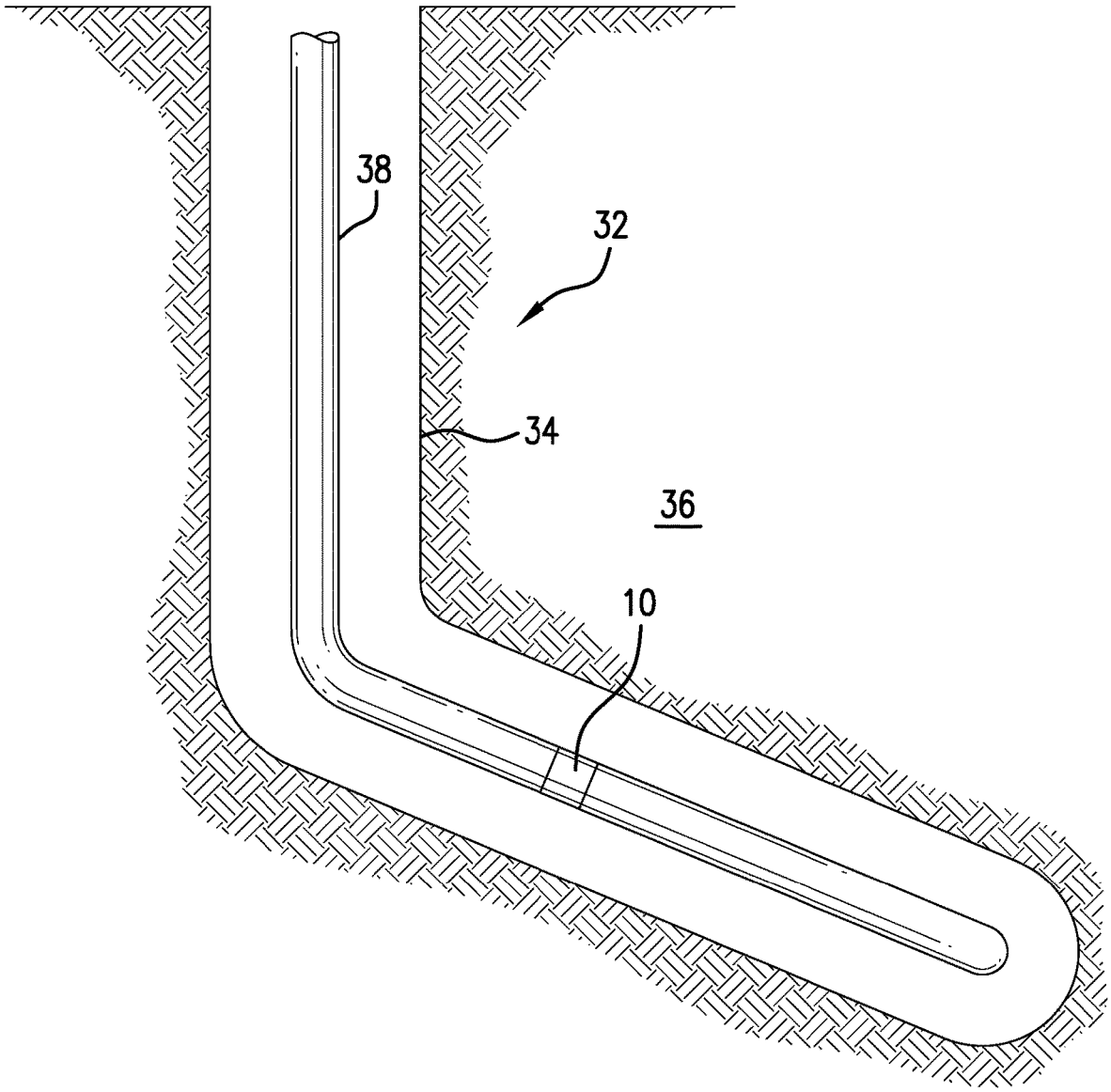
FIG. 3 is a schematic representation of a wellbore system having a biased valve therein.

Referring to FIG. 3, a wellbore system 32 is illustrated having a borehole 34 in a formation 36. Within the borehole is an optional tubing string 38 and the valve 10 is illustrated therein. It will be understood that the valve 10 disclosed herein may alternatively be run on another type of line to a position in a tubing string 38 or in an open hole.

Set forth below are some embodiments of the foregoing disclosure:

Embodiment 1

A spring biased device having a plurality of operational spring rates including a housing; a first spring disposed between a selective support and a functional component; a second spring disposed between the selective support and another support; and a releasable connection between the selective support and the housing.

Embodiment 2

The device as in any previous embodiment wherein the device is a valve.

Embodiment 3

The device as in any previous embodiment wherein the first spring is a lower spring rate than the second spring.

Embodiment 4

The device as in any previous embodiment wherein the connection is selectively mechanically defeatable.

Embodiment 5

The device as in any previous embodiment wherein the connection is selectively degradable.

Embodiment 6

The device as in any previous embodiment wherein the connection is degradable by a chemical injection fluid.

Embodiment 7

The device as in any previous embodiment wherein the connection is degradable by a slug of degradation fluid.

Embodiment 8

The device as in any previous embodiment wherein the another support is permanently fixed to the housing.

Embodiment 9

The device as in any previous embodiment wherein the another support is a second selective support selectively axially fixed to the housing.

Embodiment 10

The device as in any previous embodiment wherein the connection is a pin.

Embodiment 11

A valve including a housing; a seat disposed within the housing; a poppet movable to a position on the seat and a position off the seat, the poppet having a valve stem; a selective support; another support attached to the housing, the selective support and the another support allowing through passage of the valve stem; a first spring disposed between the selective support and the poppet; a second spring disposed between the another support and the selective support; and a connection between the selective support and the housing, the connection being selectively defeatible.

Embodiment 12

The valve as in any previous embodiment wherein the connection is degradable.

Embodiment 13

The valve as in any previous embodiment wherein the connection is responsive to a fluid applied thereto.

Embodiment 14

The valve as in any previous embodiment wherein the first spring is of a spring rate lower than that of the second spring.

Embodiment 15

A wellbore system including a borehole in a formation; a spring biased device as in any previous embodiment disposed in the borehole.

Embodiment 16

The system as in any previous embodiment wherein the device is a valve.

Embodiment 17

A method for injecting fluid including defeating a connection of a device as in any previous embodiment; changing a spring rate of the device.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A spring device having a plurality of operational spring rates comprising:
- a housing;
- a first spring disposed between a selective support and a functional component within the housing;
- a second spring disposed between the selective support and another support within the housing; and
- a releasable connection between the selective support and the housing after release of which, the first and second springs both act simultaneously to move the functional component in one direction.

2. The device as claimed in claim 1 wherein the device is a valve.

3. The device as claimed in claim 1 wherein the first spring is a lower spring rate than the second spring.

4. The device as claimed in claim 1 wherein the connection is selectively mechanically defeatable.

5. The device as claimed in claim 1 wherein the connection is selectively degradable.

6. The device as claimed in claim 5 wherein the connection is degradable by a chemical injection fluid.

7. The device as claimed in claim 1 wherein the connection is degradable by a slug of degradation fluid.

8. The device as claimed in claim 1 wherein the another support is permanently fixed to the housing.

9. The device as claimed in claim 1 wherein the another support is a second selective support selectively axially fixed to the housing.

10. The device as claimed in claim 1 wherein the connection is a pin.

11. A wellbore system comprising:
- a borehole in a formation;
- a spring device as claimed in claim 1 disposed in the borehole.

12. The system as claimed in claim 11 wherein the device is a valve.

13. A method for injecting fluid comprising:
- defeating a connection of a device as claimed in claim 1;
- changing a spring rate of the device.

14. A valve comprising:
- a housing;
- a seat disposed within the housing;
- a poppet movable to a position on the seat and a position off the seat, the poppet having a valve stem;
- a selective support;
- another support attached to the housing, the selective support and the another support allowing through passage of the valve stem;
- a first spring disposed between the selective support and the poppet;
- a second spring disposed between the another support and the selective support; and a connection between the selective support and the housing, the connection being selectively defeatible whereafter the first and second springs work simultaneously to move the poppet in one direction.

15. The valve as claimed in claim 14 wherein the connection is degradable.

16. The valve as claimed in claim 14 wherein the connection is responsive to a fluid applied thereto.

17. The valve as claimed in claim 14 wherein the first spring is of a spring rate lower than that of the second spring.

* * * * *